United States Patent [19]

Scheidweiler

[11] 4,109,240

[45] Aug. 22, 1978

[54] IONIZATION-TYPE FIRE SENSING SYSTEM

[75] Inventor: Andreas Scheidweiler, Uerikon, Switzerland

[73] Assignee: Cerberus AG., Mannedorf, Switzerland

[21] Appl. No.: 741,750

[22] Filed: Nov. 15, 1976

Related U.S. Application Data

[63] Continuation-in-part of Ser. No. 525,969, Nov. 21, 1974, abandoned.

[30] Foreign Application Priority Data

Nov. 26, 1973 [CH] Switzerland ..... 16598/73
Oct. 14, 1976 [CH] Switzerland ..... 13037/76

[51] Int. Cl.[2] ..... G08B 17/10

[52] U.S. Cl. ..... 340/629; 250/381; 331/65; 331/113 R

[58] Field of Search ..... 340/237 S, 214, 249; 250/381, 382, 384, 385, 389, 390; 307/278, 308; 328/1, 6; 331/64, 65, 113 R

[56] References Cited

U.S. PATENT DOCUMENTS

| | | | |
|---|---|---|---|
| 3,253,153 | 5/1966 | Stoddard | 331/113 R X |
| 3,308,667 | 3/1967 | Pearlman | 331/113 R X |
| 3,375,716 | 4/1968 | Hersch | 331/65 X |
| 3,559,196 | 1/1971 | Scheidweiler | 340/237 S |
| 3,775,616 | 11/1973 | Tagashira et al. | 340/237 S X |
| 3,821,699 | 6/1974 | Marus et al. | 340/59 |

*Primary Examiner*—John W. Caldwell, Sr.
*Assistant Examiner*—Daniel Myer
*Attorney, Agent, or Firm*—Flynn & Frishauf

[57] ABSTRACT

An ionization chamber is exposed to the atmosphere to be supervised, the ionization chamber being so constructed that the electrical resistance thereof changes in the presence of fire particles or aerosols upon occurrence of a fire; to improve reliability of detection, the ionization chamber is connected as a resistance element in a free-running multivibrator oscillator circuit, which includes a pair of cross-coupled field effect transistors (FET's) so that, upon change of the atmosphere to which the ionization chamber is exposed, the pulse frequency of the oscillator changes, which change is detected by a pulse rate detector. If the detector has upper and lower threshold levels, deviation of pulse rate in one direction may be used to sense presence of a fire, and in the other direction may be used to sense incipient trouble in the circuit itself.

20 Claims, 5 Drawing Figures

IONIZATION-TYPE FIRE SENSING SYSTEM

The present application is a continuation-in-part of my earlier filed application U.S. Ser. No. 525,969, filed Nov. 21, 1974.

The present invention relates to an ionization-type fire sensor system, and more particularly to such a sensing system in which an ionization chamber is provided, the electrical characteristics of which change upon presence of fire aerosols or smoke therein, and in which an electrical circuit provides an alarm output if the atmosphere in the chamber changes upon presence of a fire.

Various types of ionization-type fire alarm systems have been proposed; preferably, such systems include a chamber in which at least one radioactive substance is located, which ionizes the air in the chamber. A voltage applied to electrodes in the chamber then causes an ion current to flow therein. Upon penetration of fire aerosols or smoke into the chamber, the mobility of the charged particles changes due to the attachment effect, and the ion current decreases; as a consequence, the electrical characteristics of the ionization chamber change. Typically, the electrical resistance increases.

The change in electrical characteristics, for example the change in resistance is sensed by an evaluation circuit which then can provide an alarm output signal.

It has previously been proposed to so construct ionization-type fire alarm systems that the ionization chamber is connected in series with a reference resistance, for example another ionization chamber which is closed to the atmosphere, and hence not exposed to sense smoke or the like. The ionization chamber, and the reference resistance (for example a second ionization chamber), serially connected, are then in turn connected across a circuit which has a source of d-c voltage impressed thereacross. A d-c signal then will appear at the junction of the ionization chamber exposed to the atmosphere and the reference resistance. This d-c signal will depend on the voltage drop or, in other words, the resistance of the ionization chamber. This signal is applied to the evaluation circuit. Since the ionization chambers have a high internal resistance, so that the output resistance of the sensing element is high, difficulties arise in sensing the signal, particularly regarding stability of the operating point, amplification factor, and operating reliability.

Evaluating an output by analog evaluation is difficult. It has, therefore, previously been proposed to convert change in the resistance of the ionization chamber to a sequence of digital pulses. In such an arrangement, the ionization chamber was connected in series with a capacitor. The capacitor was charged by the ionization chamber current and, when it reached a specific charge state, it was suddenly discharged. The charge-discharge cycle was periodically repeated. The periodical discharge of the capacitor results in digital pulses which can be compared with pulses of a fixed pulse rate derived from a pulse generator. Such a system requires a substantial number of circuit components and elements and thus is subject to malfunction, interference, and additionally tends to instability.

It is known to evaluate sensed conditions, for example temperature, by including the sensor, formed as a resistance element in a multivibrator oscillator circuit, and sensing change in oscillation frequency of the multivibrator upon change in the resistance state of the sensor. The change in the oscillation frequency can then be sensed by a commercially available frequency sensor. This principle, used to measure physical parameters, cannot be applied to ionization chamber fire or smoke sensors, since the ionization chambers have resistances which are different in kind from the resistances of usual transducer units or sensors. Ionization chambers have internal resistances in the order of about $10^{11}$ ohms, or higher. This extremely high resistance requires that the transistors used in multivibrator circuits must likewise have a very high input resistance. Field effect transistors of the isolated gate MOS-FET type must be used. The remaining components of the multivibrator, such as resistors, must also be in the same order of magnitude as the resistance of the ionization chamber, resulting in substantial problems of insulation. The output frequency delivered by such a multivibrator would be extremely low and it is difficult to use commercial frequency measuring apparatus in connection therewith.

It is an object of the present invention to provide an ionization chamber fire sensor system in which the sensing output is not an analog signal, which does not have the disadvantages of known systems and which has good stability and reliability; such a system should, additionally, be effectively immune to false alarms while still having simple readily made construction.

It is a further object of the invention to provide a system which is self-checking, that is, which indicates not only a sensed fire or smoke condition but also automatically indicates departure of its normal operating or working or sensing state from a predetermined working condition, so that malfunction of the system is automatically indicated. The system should respond to various types of fires by, reliably, providing an output signal regardless of the type of fire being sensed, and operate with high sensitivity.

SUBJECT MATTER OF THE PRESENT INVENTION

Briefly, an ionization chamber smoke or fire sensor is connected to an evaluation circuit which includes two field effect transistors which are connected in a mutually crossed feedback circuit by means of two capacitors. The field effect transistors each have a gate resistor and a further resistor in the source-drain path thereof. The ionization chamber forms at least one of these resistors. This circuit operates as a pulse generator having a pulse rate which depends on the value of the various resistors and capacitors. The pulse rate, that is, the pulse repetition rate (PRR) changes with change in resistance of the ionization chamber.

The output pulses are applied to an integrator circuit or to a charge circuit which controls a switching output circuit changing its switching state upon a certain predetermined state of the charge or integrating circuit, for example by providing an alarm signal. Thus, rather than sensing a d-c voltage, the PRR or pulse frequency is used as the evaluation parameter. Supervision of the ionization chamber thus is reliable and stable.

In accordance with a feature of the invention, the ionization chamber may be a double or triple ionization chamber, thus increasing the sensitivity of the system. The various portions of the chamber can be differently constructed so that the fire sensing system will sense various types of fires which are the types of fires usually occurring, any one type of fire influencing at least one portion of the ionization chamber, thereby additionally increasing the sensitivity of the system and the sensing reliability thereof.

The invention will be described by way of example with reference to the accompanying drawings, wherein.

Basically, the system is subdivided into two parts A and B (FIGS. 1, 2) in which the portion A forms a pulse generator and the portion B forms a pulse rate or, rather, PRR detector.

Figure 1:
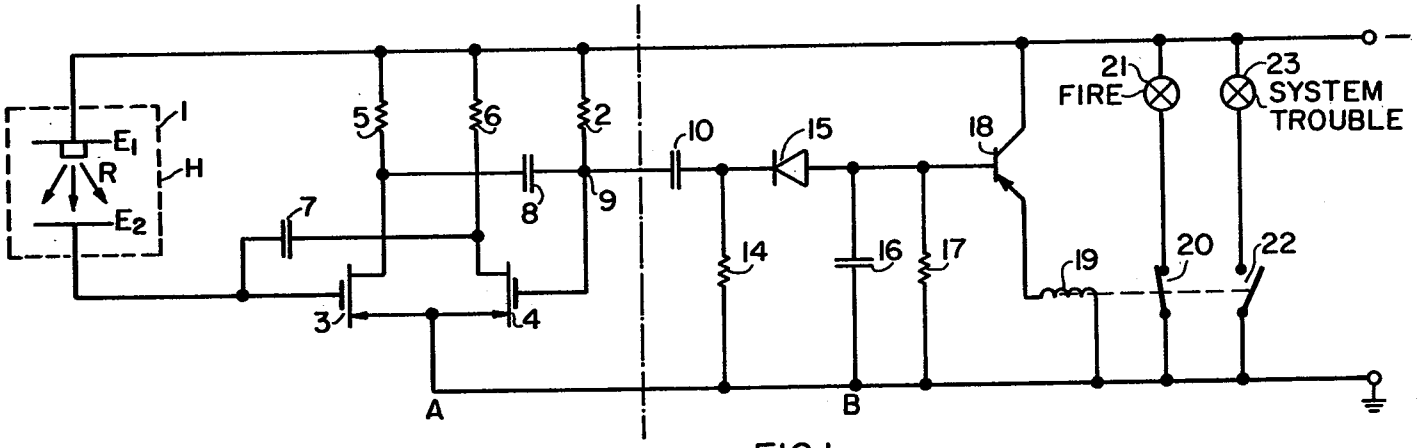
FIG. 1 is a schematic circuit diagram of the fire sensing system with a single ionization chamber.

The pulse generator A includes field effect transistors (FET's) 3, 4, resistors 1, 2 and 5, 6, as well as capacitors 7, 8 interconnected as shown in FIG. 1. The resistor 1 is formed by an ionization chamber. The gate electrodes of the FET's 3, 4 are connected to a negative supply bus; the drain electrodes are connected over resistors 5, 6 to the negative supply bus. The source electrodes are interconnected and to the positive bus. The positive supply bus is grounded. The gate of FET 3 is connected over capacitor 7 with the drain electrode of FET 4; the gate of FET 4 is connected by capacitor 8 to the drain electrode of the FET 3, so that the capacitors forms cross-connected feedback capacitors.

Any transistor with sufficiently high input resistance can be used for the FET's 3, 4. A suitable transistor is a P-channel-enhancement-MOS-FET, for example of the type MEM 520 made by General Instruments. Other suitable values for an illustrative embodiment are as follows: Drain resistors 5, 6: 10 k ohm; gate resistors 1, 2: 100 M-ohms and over. Coupling capacitors 70, 80: about 50 pf. The circuit functions similarly to a freely oscillating multivibrator having ordinary transistors. The oscillation frequency is much lower, however, so that the output terminal 9 of the circuit will have an essentially square wave output of a frequency just slightly above 1 Hz. If the resistors are non-symmetrical, it is possible to make the duration of the output pulses substantially shorter than the pulse gaps, so that the output 9 will have a signal appear thereat which is a sequence of short, narrow pulses with long pulse gaps therebetween. The PRR is determined by the value of the various components. The pulses, for example, will have a PRR of between 0.1 to 10 Hz and a pulse time which is very short with respect to the PRR, for example in the order of a few milliseconds.

The embodiment of FIG. 1 illustrates an ionization chamber with two electrodes E1 and E2 as the gate resistor 1 of the FET 3. The space between the electrodes E1 and E2 is ionized by radiation derived from a radioactive radiation source R, for example secured to one of the electrodes. The radiation source R, preferably, is secured to electrode E1, although it may be attached to any other suitable position in the chamber. The housing H of the ionization chamber is pervious to air. The structure of the ionization chamber may be in accordance with any one of the cross-referenced U.S. Pat. Nos. 3,681,603, 3,701,110, 3,767,917, 3,909,813 or 3,908,957, all assigned to the assignee of the present application. A circuit constructed with such an ionization chamber for gate resistor 1 will be extremely unsymmetrical; the output 9 thus will have a sequence of pulses of a few milliseconds duration with a pulse frequency or PRR in the order to about 1 Hz if no smoke is detected by the ionization chamber, that is, if no smoke has penetrated through the housing H into the space between the electrodes E1, E2. If, however, smoke penetrates through the housing H, then the resistance will increase and the pulse gap will increase or, in other words, the PRR will decrease.

The pulses at output terminal 9 of the sensor circuit A are applied over a coupling capacitor 10, for example of about 0.1 $\mu$ F to the pulse rate detector B. An input resistor 14, of approximately 100 k ohms and a diode 15 apply the pulses to an integration or charge circuit which, in the simplest construction, is a capacitor 16 which is successively charged by the pulses applied thereto and which can discharge over a parallel resistor 17 with a predetermined time constant. Suitable values for the capacitor-resistor network are 10 to 100 $\mu$ F for the capacitor 16 and about 100 k ohms to 1 M ohm for the resistor 17. The resistance-diode network 14, 15 prevents application of slow changes and pulses of reverse polarity to the integrating or charge/discharge circuit 16, 17. The charge state of the capacitor 16 depends directly on the PRR and rises proportionately with the pulse frequency. Capacitor 16 is connected to the base of a transistor 18 which thus receives an input voltage in dependence on the PRR. The collector current of transistor 18 thus depends proportionately on the PRR. A three-position relay, which may for example be constructed as a solenoid controlled rotary switch, is connected in the collector path of transistor 18. Relay 19 has three positions and two active contacts 20, 22, each of which is connected in series with a respective indicator lamp 21, 23. Lamps 21, 23 are connected between the supply buses. Lamp 21 is a fire alarm indicator and lamp 23 is a systems trouble indicator. When the relay is de-energized, the switch contacts 20 are closed, to open at a first threshold current flowing through relay 19. Contact 22 is normally open, remains open when the current flows at the value of the first threshold value, and closes only at a second, higher threshold current value.

Operation: Absent smoke, the PRR of the circuit A charges the capacitor 16 and permits some discharge thereof by the resistor 17, but not complete discharge, so that a certain charge value will occur across capacitor 16, resulting in some current flow through the transistor 18 at the first threshold level. This causes terminal 20 to open, but does not permit terminal 22 to close. Thus, both indicators 21, 23 will be extinguished. If the pulse rate drops so that the first threshold level of the relay 17 is passed which maintains the contact 20 in open condition, contact 20 will close and operate the indicator 21 which, as shown, is a lamp, but may also be any other alarm indicator or an operating circuit for a further remote alarm indication. This condition will obtain if smoke penetrates through the housing H, thus lowering the PRR of the circuit A, and permitting complete discharge of capacitor 16 by resistor 17 between pulses. If, for example due to malfunction in the circuit, for example due to a defect in one component, or in the insulation of the ionization chamber, the pulse rate should change so that it rises substantially above the normal value, capacitor 16 will charge to the second, higher threshold level and transistor 18 will command relay 19 to close contact switch 22 to provide a systems trouble indication.

The signal which is evaluated by the evaluation circuit B, derived at terminal 9 from the sensor A, thus is not a d-c signal but rather an alternating signal in form of a pulse sequence. This evaluation can readily be carried out simply, reliably and stably with a minimum number of components. Thus, the various separate components of the circuit need not have the stability and accuracy as components of systems of the prior art.

Figure 2:
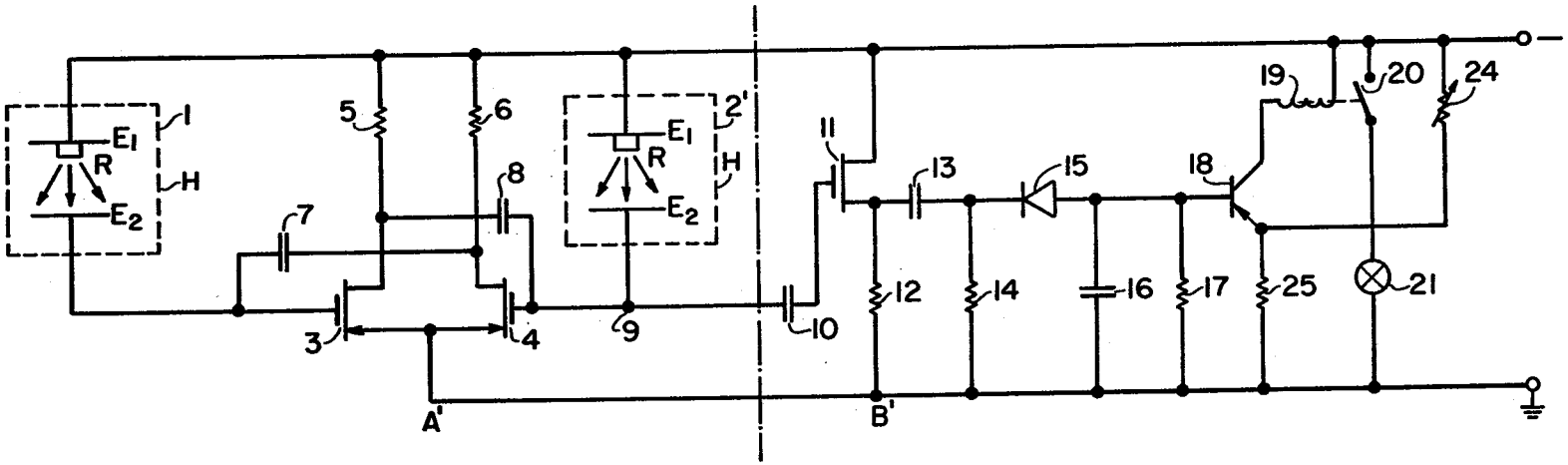
FIG. 2 shows a similar system having two ionization chambers, and also illustrating a circuit providing an adjustable alarm threshold.

In the subsequent embodiments, like parts have been given like reference numerals and will not be explained again. Referring to FIG. 2: Basically, the circuit is similar to that of FIG. 1 except that the sensor portion A uses two ionization chambers. The gate resistor 2' of FET 4 is formed as a second ionization chamber. The two ionization chambers 1, 2' can be essentially similar, or identical. The operation of the circuit of FIG. 2 is identical to that of FIG. 1, but by the provision of the additional ionization chamber 2', the sensitivity is increased since the PRR, upon penetration of fire or smoke aerosols into both ionization chambers, will exhibit a larger change. In all other respects, the sensor portion A' operates the same as that of FIG. 1.

The pulse rate detector portion B' of FIG. 2 differs from the portion B of FIG. 1 in that an additional input amplifier stage is provided, formed by an FET 11, having a source resistor 12, and applying its output signal over a further coupling capacitor 13 to the resistor-diode coupling circuit 14, 15 and then to the integrating-charge circuit 16, 17. The source resistor 12 may, for example, be about 10 k ohms, the coupling capacitor 13 about 0.1 $\mu$ F. The emitter electrode of transistor 18 is connected to a voltage divider formed of resistor 25 and adjustable resistor 24, each of, for example, about 10 k ohms. Transistor 18 will become conductive when the PRR is normal, that is, if no smoke or fire aerosols are present in the chambers 1, 2', resulting in a consequential charge on capacitor 16 which triggers transistor 18 into conduction. Relay terminal 20 is open, since relay coil 19 is energized. If, however, due to presence of smoke or fire aerosols in the ionization chambers 1, 2', the pulse rate decreases below a predetermined threshold value — the threshold of which can be controlled by adjustment of one of the resistors 24, 25, in the case of FIG. 2 resistor 24 — then transistor 18 will block, relay 19 will become de-energized and the normal closed contact 20 will close, thus permitting fire indicator 21 to signal an alarm. Of course, relay 19 can be constructed as in FIG. 1 to have three positions so that, upon high current flow through coil 19, an additional contact is energized indicating system trouble; alternatively, a second transistor circuit similar to the circuit 18, 19, may be used and set for a different threshold value to energize a separate system trouble alarm circuit.

The system of FIG. 2 has the advantage of increased, that is, effectively doubled sensitivity and a more stable threshold value for signalling alarm; additionally, the threshold can be adjusted.

Figure 3:
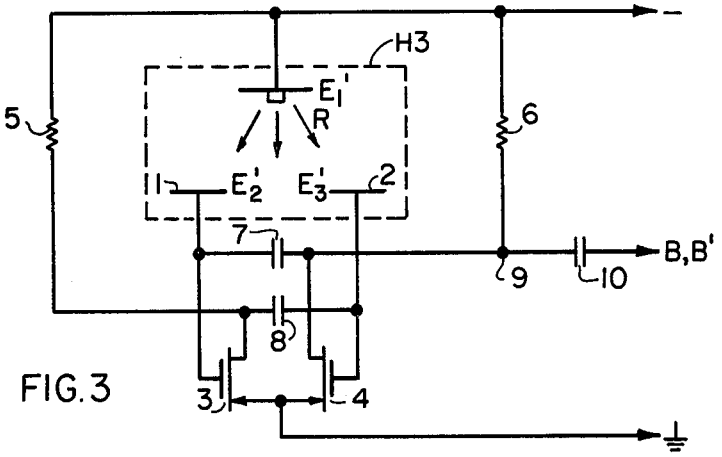
FIG. 3 is a fragmentary circuit diagram showing a double ionization chamber in the sensing circuit.

The sensor portion illustrated in FIG. 3 is basically similar to the circuit of FIG. 2, except that the two ionization chambers of FIG. 2 are combined in a single dualionization chamber within a housing H3, having a common electrode E1' connected to the negative terminal, and two counter-electrodes E2', E3', being connected with the respective gate electrodes of the respective FET's 3, 4. One part of the ionization chamber current will flow between the common electrode E1' and electrode E2'; another partial current will flow between the common electrode E1' and electrode E3'. The circuit paths correspond to resistors 1 and 2 of the circuit of FIG. 1, or the resistors 1 and 2' of the circuit of FIG. 2 and the operation of the sensor portion of the circuit of FIG. 3 is analogous to that explained in connection with FIG. 2. Any one of the PRR evaluation circuits B, B' may be connected to the circuit of FIG. 3, or any other suitable evaluation circuit may be used in which a change in frequency of a pulse train can be determined and evaluated in order to provide an alarm output signal.

Figure 4:
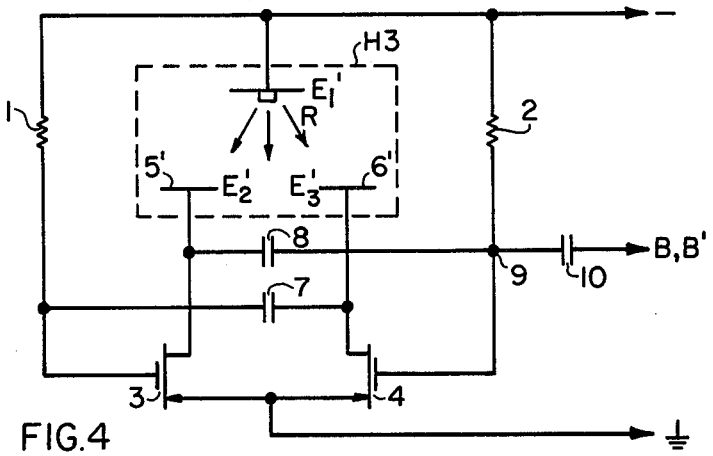
FIG. 4 is a fragmentary circuit diagram illustrating another embodiment utilizing a double ionization chamber.

The sensor of FIG. 4 is somewhat different in that change of the PRR is controlled not, as in the preceding examples, by change in the gate resistances of the FET's 3, 4, but rather by change in the drain resistances 5, 6. Thus, and in completely analogous, an ionization fire sensor having a variable PRR as an output signal can be provided. At least one of the two drain resistors 5, 6 of the sensor circuit A may be an ionization chamber. In the example of FIG. 4, both resistors 5, 6 are replaced by drain resistors 5', 6', constructed as an ionization chamber similar to chamber H3 and having three electrodes E1', E2', E3'. The ionization chambers are connected to provide two ion current paths E1'-E2' and E1'-E3'. The operation of the circuit is completely analogous to that explained in connection with the above figures, and can be similarly connected to any suitable evaluation circuit B or B' as before.

The circuits of FIGS. 3 and 4 can be combined so that both the gate resistors 1, 2, as well as the drain resistors 5, 6 of the oscillator portion can be constructed as ionization chambers. The ionization chambers corresponding to the drain resistors 5, 6 are then preferably separately insulated with respect to the ionization chambers corresponding to the gate resistors 1, 2.

Figure 5:
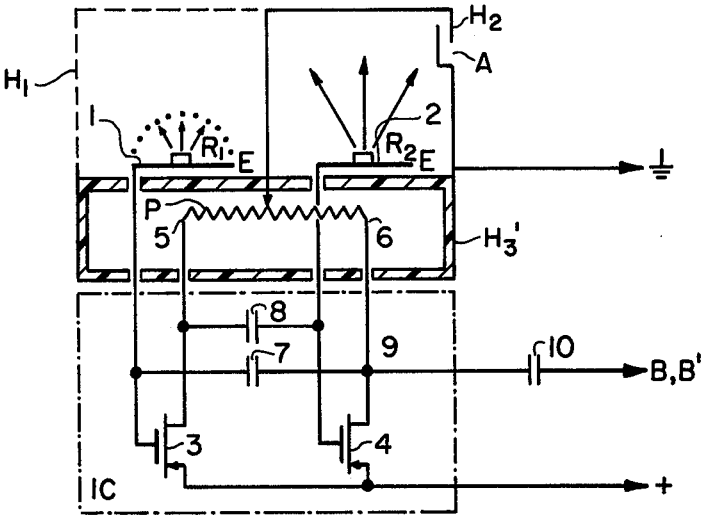
FIG. 5 is a fragmentary circuit diagram showing use of a triple ionization chamber in the system.

The sensitivity of the system can additionally be increased by constructing the ionization chambers corresponding to either one of the resistors 1, 2 or 5, 6 to be different. Referring to FIG. 5: Resistor 1 is formed as an ionization chamber H1 which is essentially open to unimpeded passage of gases or air therethrough, the housing H1 of the chamber itself forming a counter electrode to the main electrode E therein, and being connected to the negative bus of the system, similar to the connection of the electrodes E1 of FIGS. 1 and 2. The electrode E is connected to the gate of the FET 3. The radioactive source R1 is so constructed or arranged within the chamber that only a portion of the space within the chamber and located between the electrode E and the housing H is ionized. A suitable construction for such a chamber is described in U.S. Pat. Nos. 2,994,768 and 3,233,100, both assigned to the assignee of the present application. Thus, ions of only one sign are present in a portion of the ionization chamber forming resistor 1. The ion current within the chamber defined by the housing H1 thus will be unipolar current.

The resistor 2 is likewise constructed as an ionization chamber which, however, uses a radioactive source R2 arranged to ionize practically the entire interior of the chamber defined by the housing H2. Ions of both polarities are, therefore, present practically throughout the entire chamber and the ion current which will flow will be a bipolar ion current. The counter-electrode again is formed by the housing H2. The housing H2 is so constructed that air currents therein are effectively suppressed so that air flowing against the chamber can penetrate therein only with very low windage speed, that is, the penetration of air into the chamber through entrance A is shielded. Housing structures H2 which are suitable for this purpose are described in U.S. Pat. Nos. 3,731,093, 3,681,603 and 3,908,957, all assigned to the assignee of the present application. Both housing portions H1 and H2 are, preferably, metallically conductive and connected to the grounded bus. The common source connected for the two FET's 3, 4 can then be connected to the positive terminal. The drain resistors 5, 6 may be constructed as normal ohmic resistors or, preferably, as a potentiometer P as seen in FIG. 5. Alternatively, the resistors 5, 6 can be formed as ionization chambers as illustrated in FIG. 4, that is, as a dual ionization chamber within a housing H3, and having three electrodes. The housing H3 then is preferably constructed as an insulator which essentially shields the chamber therein from ambient outer air, that is, prevents ingress of smoke or at least greatly delays ingress of smoke, while permitting pressure and temperature equalization. The chamber can also be constructed in such a manner that its resistance hardly changes in spite of the presence of smoke-contaminated air or, at least, changes much less than that of the chambers within housings H1, H2.

The electrodes E within the housings H1, H2 are connected to the gate electrodes of the FET's 3, 4. The resistors 5, 6 or, as shown in FIG. 5, the two opposite portions of the potentiometer P, are connected to the drain electrodes of the two FET's 3, 4. The drain electrodes are further cross connected by capacitors 7, 8 to the gate electrodes of the respectively other FET to form a feedback connection.

The circuit portion of the multivibrator, that is, the FET's and the capacitors and — in the embodiments of FIGS. 1 to 4 also the resistors — are preferably constructed as an integrated circuit, as seen in FIG. 5 at IC, located in the socket of the fire sensor housing and having three output terminals, one of which is grounded, one forming the output terminal 9 for connection to coupling capacitor 10 and to the evaluation circuit, and the other for connection to the other power supply terminal.

Operation of the circuit of FIG. 5: The ionization chamber with bipolar characteristics, within housing H2, has the operating feature that it increases its resistance upon movement of air therein. Thus, if a stream of air passes through the chamber, it will increase its resistance and thus may simulate the presence of smoke merely due to the wind or air flow, although no fire and no smoke have occurred. The chamber within housing H2 thus has two response characteristics: (1) presence of smoke; (2) air flow therethrough. To prevent spurious response, that is, change in resistance of such a chamber without presence of smoke, it has been proposed to shield such chambers by means of shrouds, baffles, or the like, to prevent false alarms. Open fires having strong air currents will reliably result in an alarm signal; smouldering fires without strong circulation may not cause rapid response, however, since smoke penetrating into the chamber may be slowed to such an extent that its penetration therein is delayed, thus delaying an alarm. Ionization chambers with unipolar characteristic, such as the chamber within housing H1 operate differently in that the ion current is increased by air flow. Such a sensor becomes less and less sensitive upon presence of high air flow and does not cause an alarm signal. It is, therefore, possible to construct a sensing unit which has an essentially open ionization chamber permitting ready penetration by smoke and which will rapidly react to smouldering fires with heavy smoke generation but low flow of gas or air.

The combined assembly illustrated in FIG. 5 of an open unipolar ionization chamber within housing H1 and a shielded bipolar ionization chamber within housing H2, in combination with the integrated circuit IC, provides alarm output signals regardless of the type of the fire. If a fire with strong air circulation or air flow is present, a chamber within housing H2 will react; if a smouldering fire generating smoke but only little air current is present, the chamber within housing H1 will react. The sensor assembly, therefore, provides for reliable response upon presence of the types of fires which can usually be expected while avoiding disadvantages of other ionization fire sensor structures. The circuit illustrated in FIG. 5 has the additional advantage of extreme simplicity and thus reliability and resistance against defects, faults, or interferences.

Separate circuitry to evaluate change in resistance, that is, response of more than one ionization chamber, can be avoided by the construction proposed, and particularly by the system of FIG. 5. Separate evaluation circuitry connected to separate ionization cells, or to the separate electrodes of dual ionization cells can be provided and connected together by means of an OR-gate to provide output response regardless of whether one or the other cell responds. The system, as described, and particularly the system of FIG. 5, uses substantially fewer components, thus increases reliability and, inherently, operates like evaluation circuitry with an OR-gate by, reliably, providing an output signal regardless which one of the cell units or elements responds.

It is not necessary that the housing portions H1, H2 for the unipolar and bipolar ionization chambers are separate; a dual ionization chamber similar to the examples of FIG. 3, 4 can be used in which the ion path between the common electrode and electrode corresponding to one resistor is shielded with respect to air currents, whereas the other one is not, but arranged to provide for a unipolar characteristic. The circuit of FIG. 5 may be connected to an evaluation circuit B or B', as desired, to sense change of the PRR; other evaluation circuits may be used functioning similarly and indicating a change in pulse frequency to provide a consequent alarm signal.

Various changes and modifications may be made and features disclosed and described in connection with any one of the embodiments may be used with any one of the others, within the scope of the inventive concept.

I claim:

1. Smoke or fire sensing system to provide an alarm output signal upon sensing of smoke or fire aerosols within a supervised space having an ionization chamber including a source of radiation (R) and at least two electrodes (E1, E2) between which an ion current can flow, the ionization chamber being exposed to the atmosphere in the space to be supervised, and an evaluation circuit (A, B) connected to the ionization chamber and responsive to change in ion current flow of the ionization chamber when smoke or fire aerosols penetrate the chamber, wherein the evaluation circuit comprises two field effect transistors (FET's) (3, 4), each having a source electrode, a drain electrode and a gate electrode;

two drain resistors (5, 6) and two gate resistors (1, 2), the drain and gate resistors, respectively, being connected to respective FET's (3, 4);

two cross-connected capacitors (7, 8), one capacitor, each, being respectively connected to the drain electrode of one FET and to the gate electrode of the other FET to provide a cross-connecting feedback path and connect said FET's in a multivibrator oscillator circuit providing for generation of a pulse train formed by cyclically recurring pulses, the pulse repetition rate (PRR) of said pulse train depending on the value of the respective drain and gate resistors (1, 2; 5, 6);

at least one of said resistors being formed by the ionization chamber to change the pulse repetition rate of the multivibrator oscillator circuit upon presence of smoke or fire aerosols in the supervised space, and hence in the ionization chamber;

a pulse rate detector connected to the drain electrode of one of the FET's including summing means (16, 17) summing the pulses delivered from the multivibrator oscillator circuit during a predetermined time interval;

and an alarm response circuit (18, 19, 20,22; 21, 23) providing an alarm output signal when the sum of the pulses in the predetermined time interval changes from a predetermined value.

2. System according to claim 1, wherein the field effect transistors (3, 4) comprise p-channel enhancement FET's of the MOS-FET type.

3. System according to claim 1, wherein the field effect transistors (3, 4) comprise p-channel enhancement FET's, the source electrodes of the FET's being connected together and to a positive supply source, the free terminals of the gate resistors (1, 2) and of the drain resistors (5, 6) being connected to the negative supply source.

4. System according to claim 1, wherein (FIGS. 1-3, 5) at least one of the gate resistors of the FET's is formed as an ionization chamber.

5. System according to claim 1, wherein (FIG. 4) at least one of the drain resistors of the FET's is formed by the ionization chamber.

6. System according to claim 1, wherein (FIG. 3) both gate resistors (1, 2) are formed by the ionization chamber.

7. System according to claim 1, wherein both drain resistors (5, 6) are formed by the ionization chamber.

8. System according to claim 1, wherein (FIG. 3) both gate resistors (1, 2) are formed by the ionization chamber, said ionization chamber comprising a double or dual ionization chamber having three electrodes, one of which forms a common electrode and the other two being connected to respective gate electrodes of the FET's (3, 4), the ion current paths between the common electrode and the respective second and third electrodes forming said resistors.

9. System according to claim 1, wherein (FIG. 4) both drain resistors (5, 6) are formed by the ionization chamber, said ionization chamber comprising a double or dual ionization chamber having three electrodes, one of which forms a common electrode and the other two being connected to respective drain electrodes of the FET's (3, 4), the ion current paths between the common electrode and the respective second and third electrodes forming said resistors.

10. System according to claim 1, wherein (FIG. 5) one of the resistors of two respective resistors is formed as an ionization chamber with unipolar characteristic located in an essentially air-pervious housing (H1) permitting passage of air flow therethrough, the other resistor being formed as an ionization chamber with bipolar characteristic located within a housing (H2) open to the atmosphere but inhibiting air currents therethrough.

11. System according to claim 1, wherein (FIG. 5) one of the gate resistors (1) is formed as an ionization chamber with unipolar characteristic, located in an air-pervious housing (H1) permitting air current to flow therethrough, the other gate resistor (2) being formed by an ionization chamber with bipolar characteristic located within a housing (H2) preventing air current from flowing therethrough.

12. System according to claim 11, wherein said housings (H1, H2) are electrically connected.

13. System according to claim 12, wherein said housings (H1, H2) comprise a mechanical unit or assembly.

14. System according to claim 1, wherein the summing means (16, 17) comprises a capacitor (16) and a discharge resistor (17) connected in parallel thereto, the capacitor-resistor combination having said predetermined time constant.

15. System according to claim 1, further comprising a coupling capacitor (10, 13) and a diode (15) connected in series therewith, said capacitor-diode series circuit being connected between the drain electrode of one of said FET's and said summing means.

16. System according to claim 1, wherein the alarm response circuit is connected to sense, separately, change of the pulse repetition rate of the multivibrator oscillator circuit in increasing, as well as in decreasing direction;

and said circuit further comprises separate alarm indicators indicating, separately, the respective deviation in increasing or decreasing direction of the pulse repetition rate from said predetermined level.

17. System according to claim 16, wherein the alarm response circuit comprises a transistor (18) connected to said summing means and having a first state of conduction when the sum of the pulses in said predetermined interval is at said predetermined level;

said transistor changing conduction to a higher or lower state upon deviation of the sum of the pulses within said predetermined time interval from said level, the circuit means indicating, respectively, occurrence of said and, the direction of said change.

18. System according to claim 16, wherein (FIG. 5) one of the gate resistors (1) is formed as an ionization chamber with unipolar characteristic, located in an air-pervious housing (H1) permitting air current to flow therethrough, the other gate resistor (2) being formed by an ionization chamber with bipolar characteristic located within a housing (H2) preventing air current from flowing therethrough.

19. System according to claim 1, wherein the alarm response circuit comprises a switching transistor (18), the base of which is connected to said summing means (16, 17), the operating or working point of said switching transistor being selected to render the transistor conductive when the summed pulses within said predetermined time interval change, in increasing or decreasing direction from said predetermined level.

20. System according to claim 19, further comprising adjustable voltage divider means (24, 25) connected to the emitter electrode of the transistor (18) to adjust the switching level thereof.

* * * * *